US005216417A

United States Patent [19]

Honda

[11] Patent Number: 5,216,417

[45] Date of Patent: Jun. 1, 1993

[54] MULTI-TONE LEVEL DISPLAYING METHOD BY BI-LEVEL DISPLAY DEVICES AND MULTI-TONE LEVEL DISPLAYING UNIT

[75] Inventor: Hiroyasu Honda, Suwa, Japan

[73] Assignee: Seiko Epson Corporation, Tokyo, Japan

[21] Appl. No.: 704,140

[22] Filed: May 22, 1991

[30] Foreign Application Priority Data

May 22, 1990 [JP] Japan ..... 2-132274
Sep. 4, 1990 [JP] Japan ..... 2-233781

[51] Int. Cl.[5] ..... G09G 3/20
[52] U.S. Cl. ..... 340/793; 340/784
[58] Field of Search ..... 340/793, 767, 784; 358/455, 456, 457

[56] References Cited

U.S. PATENT DOCUMENTS 3,937,878 2/1976 Judice ..... 340/767
4,559,535 12/1985 Watkins et al. ..... 340/793
4,769,713 9/1988 Yasui ..... 340/793
4,808,991 2/1989 Tachiuchi et al. ..... 340/793
4,921,334 5/1990 Akodes ..... 340/793
5,053,764 10/1991 Barbier et al. ..... 340/793

*Primary Examiner*—Jeffery A. Brier
*Attorney, Agent, or Firm*—Spensley Horn Jubas & Lubitz

[57] ABSTRACT

In a bi-level displaying device, dither signal trains $Y_0$ to $Y_{15}$ for displaying half tone levels are generated from signal trains for basic tone levels $X_0$ to $X_{16}$ and from a $\frac{1}{2}$ dither pattern constituted by the same numbers of dots having different threshold values. Dither signal trains $Z_0$ $Z_{31}$ for displaying unequally divided intermediate tone levels are generated by the basic trains $X_0$ to $X_{16}$ from a $\frac{1}{4}$ dither pattern and a $\frac{3}{4}$ dither pattern which are associated with unequal numbers dots having the different threshold values. Since the unequally divided intermediate tone levels can be displayed easily, it becomes possible to get natural intermediate tone levels. A dither pattern having a reversed pattern is adopted so that twice the number of intermediate tone levels can be displayed. Hence, a total of 64 tone levels can be displayed to produce images with fine detail and high resolution.

10 Claims, 14 Drawing Sheets

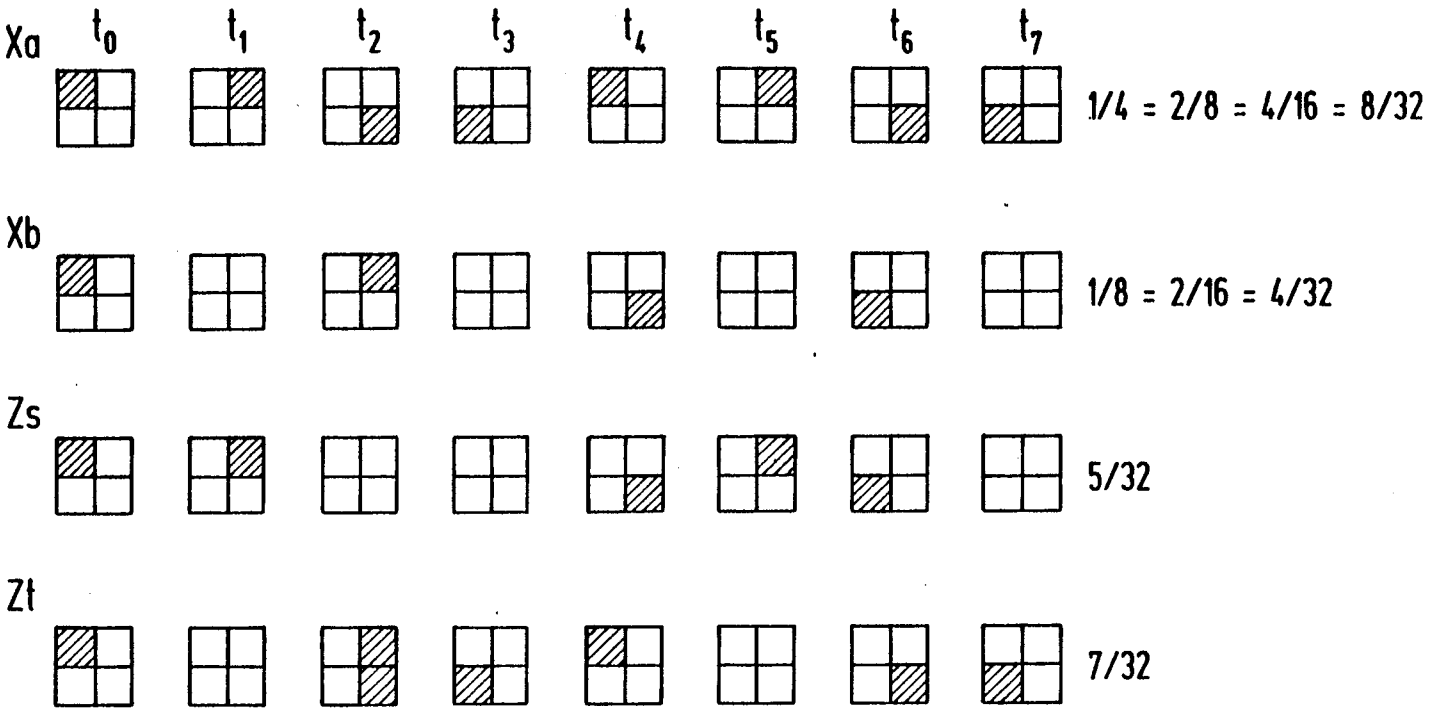
FIG. 1(a)
FIG. 1(b)
FIG. 1(c)
FIG. 1(d)
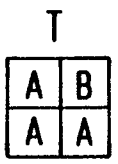
FIG. 2(a)
FIG. 2(b)

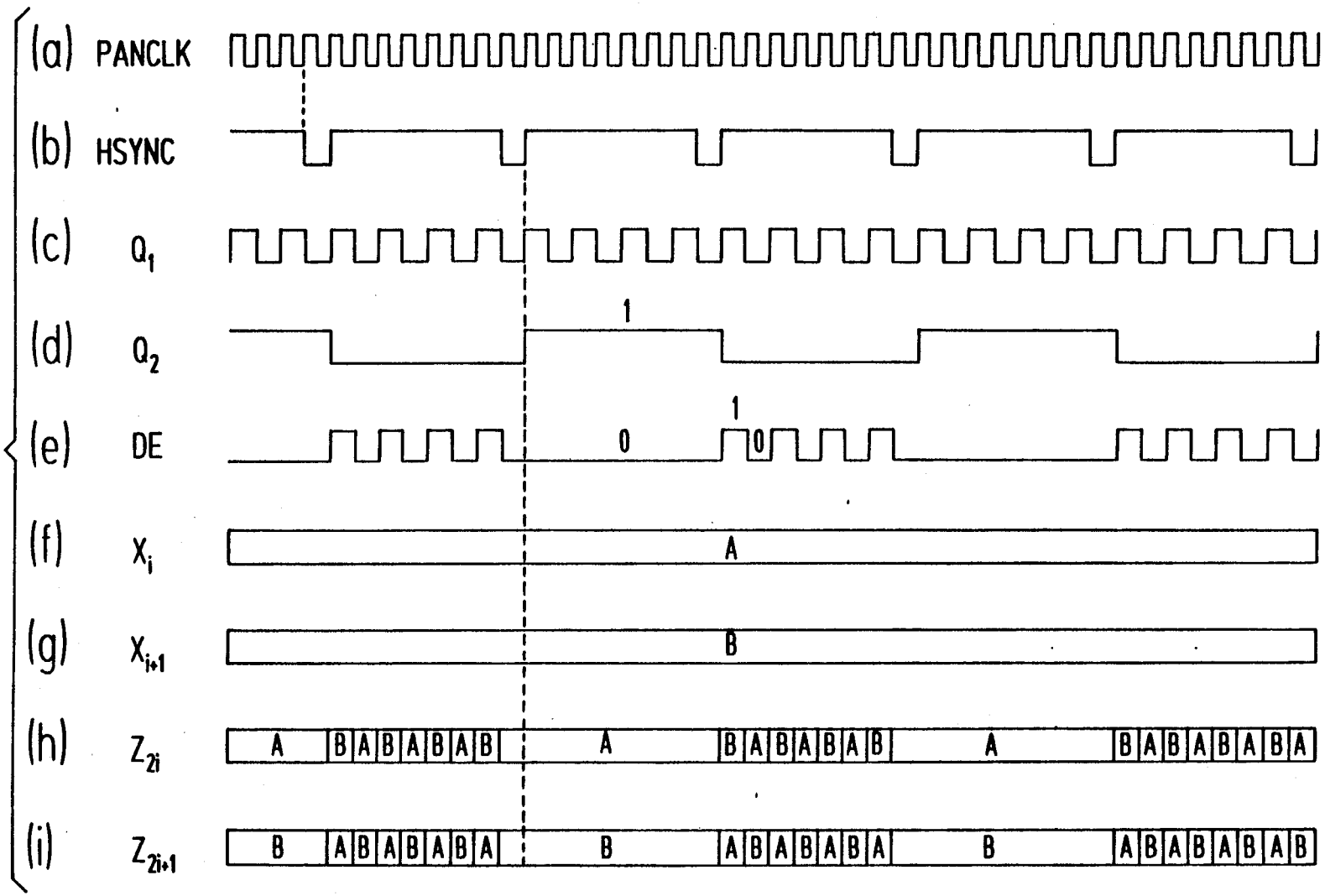
(a) PANCLK
(b) HSYNC
(c) $Q_1$
(d) $Q_2$
(e) DE
(f) $X_i$
(g) $X_{i+1}$
(h) $Z_{2i}$
(i) $Z_{2i+1}$
1
0
1
0
A
B
A B A B A B

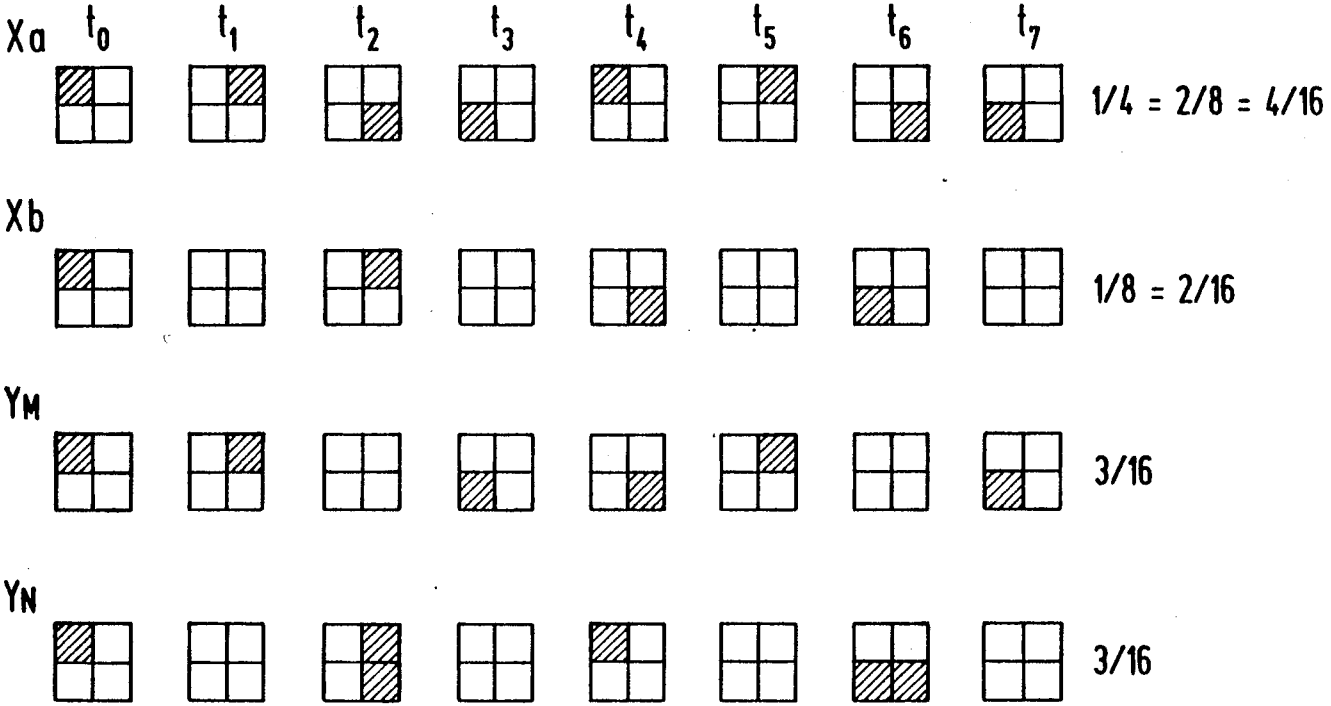
FIG. 14(a)
FIG. 14(b)
FIG. 14(c)
FIG. 14(d)
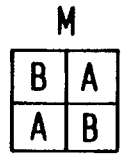
FIG. 15(a)
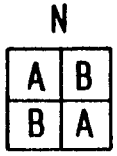
FIG. 15(b)

MULTI-TONE LEVEL DISPLAYING METHOD BY BI-LEVEL DISPLAY DEVICES AND MULTI-TONE LEVEL DISPLAYING UNIT

BACKGROUND OF THE INVENTION

1. Field of the Invention

The present invention relates to a method and unit for displaying images having multi-tone levels, in which a number of intermediate brightness levels are included, on a liquid crystal display (LCD), an AC type plasma display panel (PDP), or other bi-level display devices. More particularly, this invention pertains to the display of a number of intermediate tone levels based on basic tone levels using a dither method.

2Related Art Descriotion

Dither methods have been known as typical methods for generating signals for displaying half tone levels when images are displayed by a method involving mixed use of divided times and divided areas. Such methods are commonly used for displaying on an LCD whose picture elements can be only light or dark.

An explanation will now be given of the manner of displaying half tone levels when images are displayed by the method of divided times and divided areas. In this method, a typical picture element comprises a rectangular array, or group, of 2×2 dots (displaying cells) and each dot can display only a selected one of 2 brightness levels such as light and dark. The brightness of a picture element is changed according to a combination of light and dark dots, so that one picture element, constituted by 2×2 dots, can exhibit as many as 5 brightness levels. In general, the number of possible brightness levels of a multidot picture element is one greater than the number of dots.

In addition the brightness level of such picture element can also be changed by a combination of divided times or time division, since the states of the dots are changed to light or dark depending on the divided times. This method for displaying half tone levels using the divided times and divided areas, is usually called Frame Modulation, hereinafter FRM.

For example, on an LCD whose basic picture element consists of 3×2 dots, a $\frac{1}{4}$ tone level is displayed as follows. In this example, one cycle of display on the LCD is divided into 8 time intervals so that a basic pattern is displayed periodically. As shown in FIG. 14 (a), for a basic pattern which is displayed at each time interval, one of the 2×2 dots is in its light state (represented by a black area) and the location of the dot which is in the light state is changed at each time interval. In order to maintain the quality of tone level display, as shown in the basic patterns of FIG. 14, the state of the dots in the next pattern should be changed to dark from light, as far as possible. For example, the location of the light dot in one picture element, can be shifted clockwise from one time interval to the next.

A $\frac{1}{8}$ tone level, which is a lower tone level than, but an adjoining level to, the $\frac{1}{4}$ (2/8) level, is displayed. by a train of displaying patterns Xb shown in FIG. 14 (*b*). The train Xb is generated based on the patterns of train Xa shown in, FIG. 14 (*a*), and a basic pattern of a totally dark picture element alternates with successive picture element patterns containing at least one light dot. By the above method, nine tone levels, i.e. 0/8 tone level to 8/8 tone level, can be displayed by a picture element having 2×2 dots when the FRM method with 8 time intervals is adopted.

Further tone levels may be displayed using the dither method and basic tone levels generated by FRM as explained above. For. example, a train of display patterns Ym shown in FIG. 14 (*c*), is generated from a combination of selected elements of trains Xa (FIG. 14 (*a*)) and Xb (FIG. 14 (*b*)) using a dither matrix (dither pattern) M which is shown in FIG. 15 (*a*). The dither matrix M shown in FIG. 15 (*a*) is a matrix of 2×2 dots and this matrix corresponds to a picture element. An 'A' in the matrix M is a threshold value or a selecting parameter. The function of 'A' assigned to a dot of matrix M is to select the state (light or dark) of the corresponding dot in the pattern of the train Xa, but to ignore the state of the corresponding dot in the pattern of the train Xb. The function of 'B' assigned to the other dots of matrix M is to select the state of the corresponding dot in the pattern of the train Xb, but to ignore the state of the corresponding dot in the pattern of the train Xa. By the train Ym generated by the above method, a 3/16 tone level is displayed, and this tone level is, from a theoretical point of view, a middle tone level between the tone level 4/16 ($=\frac{1}{4}$) displayed by the train Xa and the tone level 2/16 ($=\frac{1}{8}$) displayed by the train Xb.

Another dither matrix N shown in FIG. 15 (*b*) is the inverse of the matrix M, and the locations of 'A' and 'B' are interchanged with those of matrix M. By this dither, matrix N, a train of display patterns Yn, shown in FIG. 14 (*d*), is generated and the a tone level displayed by this train Yn is also 3/16. However, in the train Yn, there are patterns which have two light dots, and patterns containing at least one light dot appear in alternation with dark patterns, i.e. without light dots. Therefore, the quality of a displayed image with the tone level of train Yn is poorer than that of the train Ym.

As illustrated in FIG. 16, if each display cycle is composed of, for example, 16 time intervals, 17 tone levels can be generated by FRM, and with the dither method explained above, 16 further dither tone levels will be newly generated. In order to maintain compatibility with the quantity of bits of IC used on the display unit, the number of tone levels is selected to be a power of 2. For example, in FIG. 16, 16 tone levels can be displayed by the trains of basic tone signals $X_)$ to $X_{15}$ generated by FRM, except the train $X_{16}$. And 16 tone levels can be displayed by the trains of dither tone signals $Y_0$ to $Y_{15}$. So, a total number 32 tone levels can be displayed.

Meanwhile, when the conventional dither method is used and images displayed by the method in which time division and area division are used, due to the following reasons, the maximum number of tone levels to be e displayed is limited to 32. The number of brightness levels of a picture element can be increased beyond 5 if picture elements are constituted by 3×3 dots or more. However, since this produces an increase in the dimensions of the picture element, image resolution and detail are reduced. In addition, a large number of different patterns will be displayed cyclically, so that the images will flicker. Hence, in order to get a fine image, the frame frequency of the displaying unit should be increased.

SUMMARY OF THE INVENTION

Accordingly, it is a primary object of the present invention to provide a method for generating signal trains by which multi-tone level, beyond 32 tone levels, can be displayed on bi-level display devices.

A further object of the present invention is to provide a multi-tone level displaying unit on which multi-tone levels are displayed by the above-mentioned newly generated signal trains.

The above and other objects are achieved, according to the present invention, by using the conventional dither method to generate trains by which half tone levels are displayed, and the trains are generated based on a pair of basic trains by which a first tone level and an adjoining second tone level are displayed. In addition to the above, 2 different tone levels are displayed between the first and second tone levels using a first binary dither pattern and a second binary dither pattern which is the inverse of the first dither pattern.

The first and second dither patterns comprise dots corresponding to that of a picture element, and different threshold values are assigned to the dots so that the numbers of dots with different threshold values are unequal. In order to obtain an image having greater detail and resolution, it is better that the picture elements consist of $2\times2$ dots. And, the first and second dither patterns are constituted by $2\times2$ dots corresponding to the constitution of the picture elements.

When the first and second dither patterns are used, in order to keep the detail and the resolution of the images, adjoining picture elements should be displayed according to alternative usage of differently arranged dither patterns. In these dither patterns, arrangements of threshold values are changed but the numbers of dots assigned by the different threshold value are kept as the first or second dither pattern. In addition, in order to display images without stripe patterns, the first and second dither pattern should be constituted by vertical dot lines and horizontal dots lines in which at least one different threshold value is located per each pattern.

The above method is adapted to a multi-tone level displaying unit. In the displaying unit, based on signal trains $X_i$ and $X_{1+1}$, which are a pair of signal trains among signal trains for displaying basic tone levels including a first tone level and a second tone level signal trains $Z_{1i}$ and $Z_{2i+1}$ are generated, and unequally divided intermediate tone levels between the first and second tone levels are displayed thereby so that multi-tone levels are displayed on a bi-level displaying array whose individual dots can each only produce a light or dark display.

The multitone level displaying unit is constituted by a dither enable signal generating means and a dither tone level output means. The dither enable signal generating means generates a dither enable signal by which a first threshold value and a second threshold value different from the first are assigned to the dots in the picture element defined based on a predetermined number of dots, so that different numbers of dots are assigned to different threshold values. The dither tone level output means generates the signal trains $Z_i$ and $Z_{u+1}$ compounding the signal trains $X_i$ and $X_{i+1}$ serially and/or alternatively under the control of the dither enable signal.

The dither enable signal generating means comprises a picture element defining means for defining a picture element according to the predetermined number of dots based on panel clock signals and on horizontal synchronizing signals of display cell and threshold value assigning means for generating the dither enable signal in which the first and second threshold values are so arranged that different numbers of dots in the picture element are assigned to the different threshold values. In addition, to get images without stripes, the dither enable generating means comprises a picture element defining means for generating signals for defining a picture element to have $4\times4$ dots on the basis of the panel clock signals and horizontal synchronizing signals of the display cells, and a threshold assigning means for generating the dither enable-signal in which the first and second threshold values are arranged so that each vertical and horizontal dots line in the picture elements has at least one different threshold value.

The dither tone level generating means comprises signal selecting means by which one of the signal trains $X_i$ and $X_{i+1}$ is selected alternately in accordance with the dither enable signal. In addition, the signal selecting means are classified as pairs, and the signal trains $X_i$ and $X_{i+1}$ are interchangeably supplied to two input terminals of each selecting means in each pair.

According to the above-described display method of intermediate tone levels, in addition to half tone levels based on the pair of basic tone levels (the first tone levels and the second tone levels), unequally divided intermediate tone levels are displayed based on the pair of above basic tone levels and the first binary dither pattern which is constituted by the different numbers of dots assigned by the different threshold values.

If a natural tone level between the first tone level and the second tone level is required, it may be impossible to get such natural tone level only by half tone levels according to the conventional dither method and, therefore, the displayed image would be unnatural. However, on the basis of the multi-tone level displaying method according to this invention, it is possible to select unequally divided tone levels among widely extended tone levels according to requirements. Therefore, a required natural tone level will be added to the images to be displayed. In addition, using the first dither pattern constituted by the unequal numbers of dots assigned by the different threshold values, and the second dither pattern having a pattern inverse to the first dither pattern, double intermediated tone levels can be displayed.

In addition, when the first and second dither pattern are used and they are constituted by vertical and horizontal dot lines having at least one different threshold value per each pattern, it become possible to reduce stripes and cross-talk in displayed images.

In a multi-tone level displaying unit adopting the above method, the dither enable signal is generated by the dither enable signal generating means. By the dither enable signal, the displaying array is handled by picture elements defined based on the predetermined number of dots, and the first and second threshold value are assigned to the dots so that an unequal number of dots are assigned to the different threshold values. And by the dither tone output means, the signal trains $Z_{2i}$ and $Z_{2i+1}$ are generated by compounding a pair of basic trains for basic tone levels serially and/or alternatively, and un-equally divided tone levels are displayed by the trains $Z_{2i}$ and and $Z_{2i+1}$ above.

BRIEF DESCRIPTION OF THE DRAWING

FIGS. 1(*a*), 1(*b*), 1(*c*), and 1(*d*) are pictorial illustrations representing a multi-tone level displaying method on a bi-level displaying method according to an embodiment of the present invention.

FIGS. 2(*a*) and (*b*) illustrate dither patterns used in the displaying method according to an embodiment of the present invention.

FIGS. 9(*a*), 9(*b*), 9(*c*), 9(*d*), 9(*e*), 9(*f*), 9(*f*), 9(*g*), 9(*h*), and 9(*i*), are timing charts illustrating operation of the intermediate tone level generating portion of FIG. 8.

FIGS. 10 (*a*) illustrates combinations of dither patterns used in a multi-tone level displaying unit according to embodiment of the invention shown in FIG. 11.

FIGS. 14(*a*), 14(*b*), 14(*c*), and 14(*d*) illustrate a conventional intermediate tone level displaying method in bi-level displaying device.

FIGS. 15(*a*) and 15(*b*) illustrate dither patterns used in the displaying method of FIG. 14.

FIG. 15 illustrates a model of the displaying method of FIG. 14.

DESCRIPTION OF THE PREFERRED EMBODIMENTS

The invention will now be described in detail with reference to the attached drawings.

Referring to FIGS. 1 to 9, an embodiment of the present invention will be described. FIGS. 1 illustrate trains of display patterns associated with a generating method of multi-tone levels according to the present invention., FIG. 1(*a*) shows a train of display patterns Xa. Each picture element shown in FIGS. 1 has 2×2 dots. The tone level produced by train Xa is $\frac{1}{4}$, and 8 equal time intervals are included in one cycle. FIGS. 1(*b*) shows a train of display patterns Xb, and a tone level of $\frac{1}{8}$ is produced thereby. FIGS. 1(*a*) and (*b*) are identical to FIGS. 14(*a*) and (*b*).

FIG. 2(*a*) shows a dither matrix S which is used in this embodiment. A certain dot of this matrix S is assigned a threshold value or a selecting parameter 'A'. The other dots of matrix S are assigned a threshold value or a selecting parameter 'B' which has a value inverse to 'A'. The function of 'A' is to select the state of the corresponding dot in the patterns of the train Xa and to ignore that of the train Xb. Conversely, 'B' selects the state of the corresponding dot in train Xb and ignores that of train Xa. Using the dither matrix S, a train of output patterns Zs is generated as shown in FIG. 1(*c*). The tone level to be displayed by the train Zs is 5/32 and this level corresponds to $\frac{1}{4}$ of the range from 4/32 (=$\frac{1}{8}$) tone level to 8/32 (=$\frac{1}{4}$) tone level.

On the other hand FIG. 2(*b*) shows a dither matrix T which is an inverse matrix of the matrix S. In the matrix T, a certain dot is assigned by 'B' and the other dots are assigned 'A'. Using the matrix T, a train of output patterns Zt is generated as shown in FIG. 1 (*d*). The tone level to be displayed by train Zt is 7/32, and this level represents $\frac{3}{4}$ of the range from 4/32 tone level to 8/32 tone level.

In addition, a train for displaying a tone level of 6/32 can be generated by the conventional method using dither matrix M or N shown in FIGS. 15, as explained above.

Figure 3:
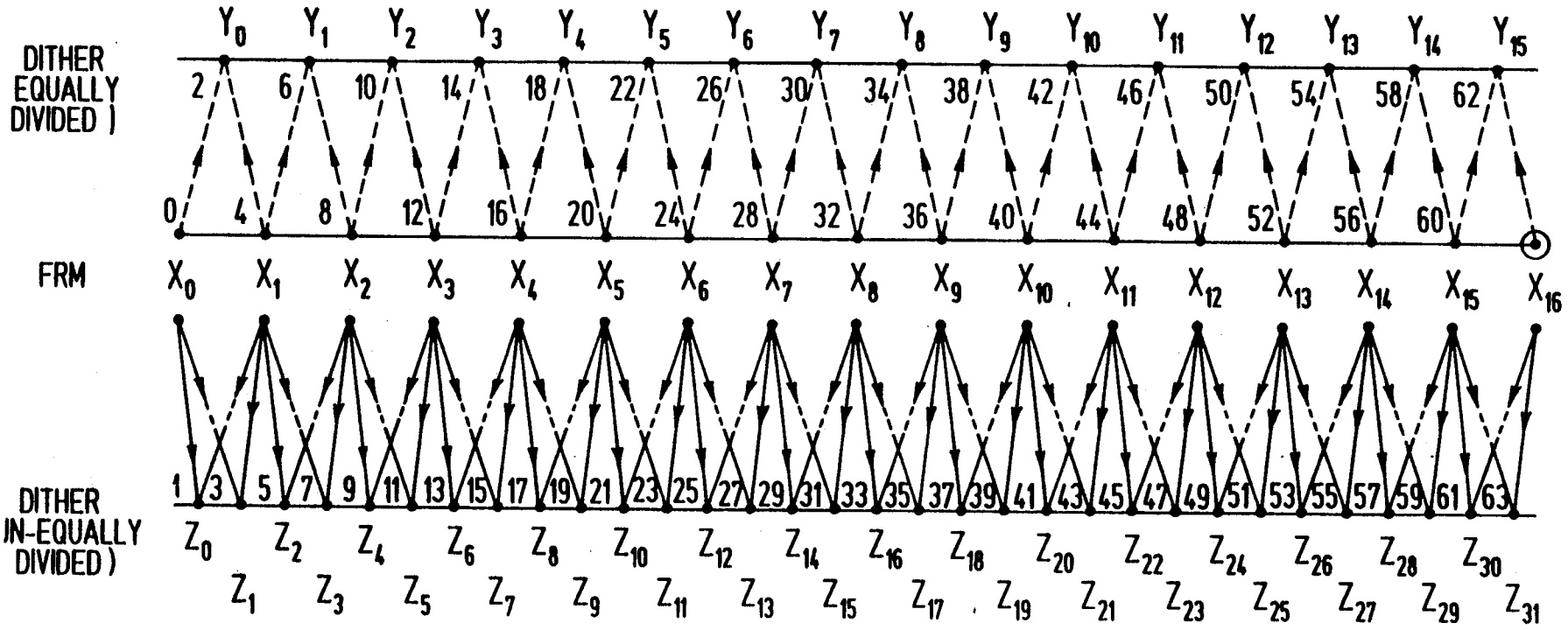
FIG. 3 illustrates the multi tone level displaying method on bi-level displaying device according to an embodiment of the present invention.

FIG. 3 illustrates a method for generating trains of output patterns according to the invention by which a total of 64 tone levels can be displayed. For this purpose, each display cycle is made up of 16 time intervals. By the method described before, basic trains ($X_0$ to $X_{16}$) for displaying 17 tone levels are generated by the FRM method. Based on these basic trains, trains ($Y_0$ to $Y_{15}$) by which another 16 tone levels is displayed, are generated using dither matrix M or N shown in FIGS. 15. In addition, based on the basic trains, trains ($Z_0$ to $Z_{31}$) are generated using the dither matrices S and T and another 32 tone levels can be displayed thereby. Therefore, 64 (16+16+32) tone levels can be displayed by the trains generated above.

As explained above, based on the two basic trains, which are generated by the FRM method and the adjoining basic tone level displayed thereby, the new train for displaying $\frac{1}{4}$ intermediate tone levels between the above basic levels is generated using the dither matrix S in which only one dot is assigned the parameter for selecting one of the basic trains. And based on the same basic trains, the new train for displaying a $\frac{3}{4}$ intermediate tone level is generated using the dither matrix T where only one dot is assigned the other parameter for selecting the other basic train.

Therefore, although the number of the time intervals of one display cycle remains as before, using the above new trains, twice the number of tone levels can be displayed.

Figure 4:
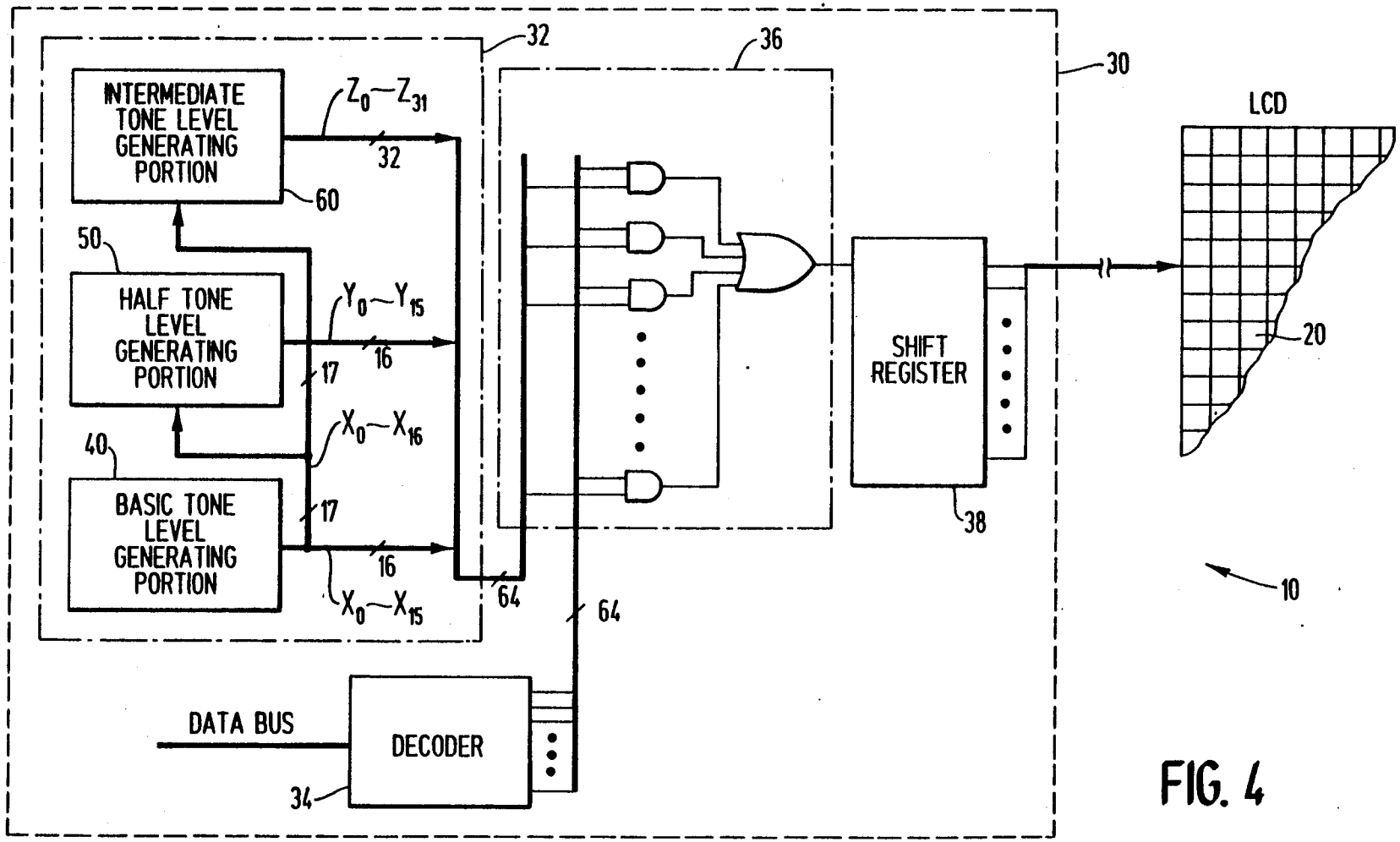
FIG. 4 is a block diagram showing a multi-tone level displaying unit according to an embodiment of the invention.

Referring to FIGS. 4 to 10, a multi-tone level displaying unit 10 according to an embodiment of the invention will be described. FIG. 4 is a block diagram showing the basic arrangement of the multi-tone displaying unit according to this embodiment using a liquid crystal display (LCD). Multi-tone displaying unit 10 is constituted by an LCD panel 20 and a data signal generating portion 30. The LCD panel 20 is a typical LCD panel in which liquid crystal cells (dots) are arranged in a matrix.

The data signal generating portion 30 is composed of a multi-tone level generating portion 32, a tone level applying portion 36 for weighting color data which are generated by a decoder 34 based on tone level signals for displaying 64 tone levels from the tone level generating portion 32, and a shift register 38 for converting serial data into parallel form. The multi-tone level generating portion 32 has a basic tone level generating portion 40, a half tone level generating portion 50, and an intermediated tone level generating portion 60.

The basic tone level generating portion 40 generates basic trains $X_0$ to $X_{16}$ for displaying 17 tone levels by the typical FRM method. The half tone generating portion 50 generates trains $Y_0$ to $Y_{15}$ for displaying half tone levels, i.e. equally divided tone levels each located between a pair of adjacent basic tone levels, using a dither method based on the two adjacent basic trains, and the pair of basic trains is constituted by one basic train and the adjoining basic train among the basic tone levels from the basic tone level generating portion 40.

The intermediate tone level generating portion 60 generates trains $Z_0$ to $Z_{31}$, using a dither method based on the above pairs of basic tone level trains.

Figure 5:
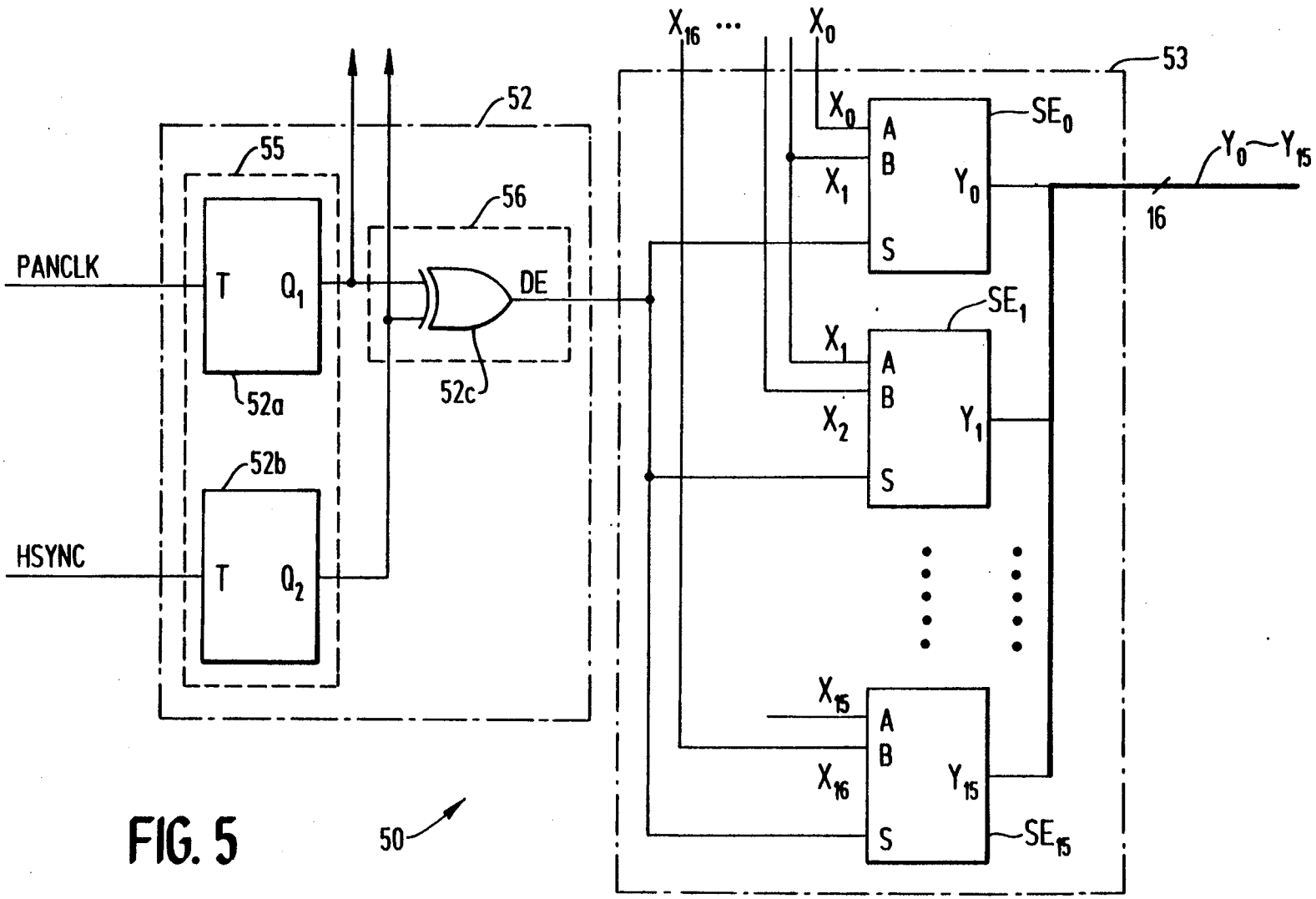
FIG. 5 is a block diagram showing a half tone level generating portion of the multi-tone level displaying unit of FIG. 4.

Referring specifically to FIG. 5, the half tone generating portion 50 has a dither enable signal generating circuit 52 for generating a dither matrix in which two different selecting parameters (threshold values re arranged chequerwise in 2×2 dots, and a half tone level signal output circuit 53 which is constituted by selectors $SE_0$ to $SE_{15}$ for selecting a displaying signal train based on a pair of basic trains composed of basic train $X_i$ and the adjoining train $X_{i+1}$, selected from among the basic trains $X_0$ to $X_{16}$, in accordance with the level of dither enable signal DE generated by the dither enable signal generating circuit 52.

The dither enable signal generating circuit 52 are a T-flip-flop circuit 52*a* which is a ½ counting-down, or dividing, circuit of a panel clock signal PANCLK, a T-flip-flop circuit 52*b* which is a ½ counting-down, or dividing, circuit of a horizontal synchronizing signal HSYNC, and an exclusive-OR circuit 52*c* for generating the dither enable signal DE based on the output Q1 from the T-flip-flop circuit 52*a* and the output Q2 from the T-flip-flop circuit 52*b*. The T-flip-flop circuit 52*a* and the T-flip-flop circuit 52*b* constitute a picture element definition circuit 55 for fixing a range of picture elements to each have 2×2 dots, and the dither matrix is adapted to this picture element. The exclusive-OR circuit 52*c* is a threshold value applying circuit 56 for assigning a selecting parameter or a threshold value to each dot of a 2×2 dot matrix which defines a picture element.

Figure 6:
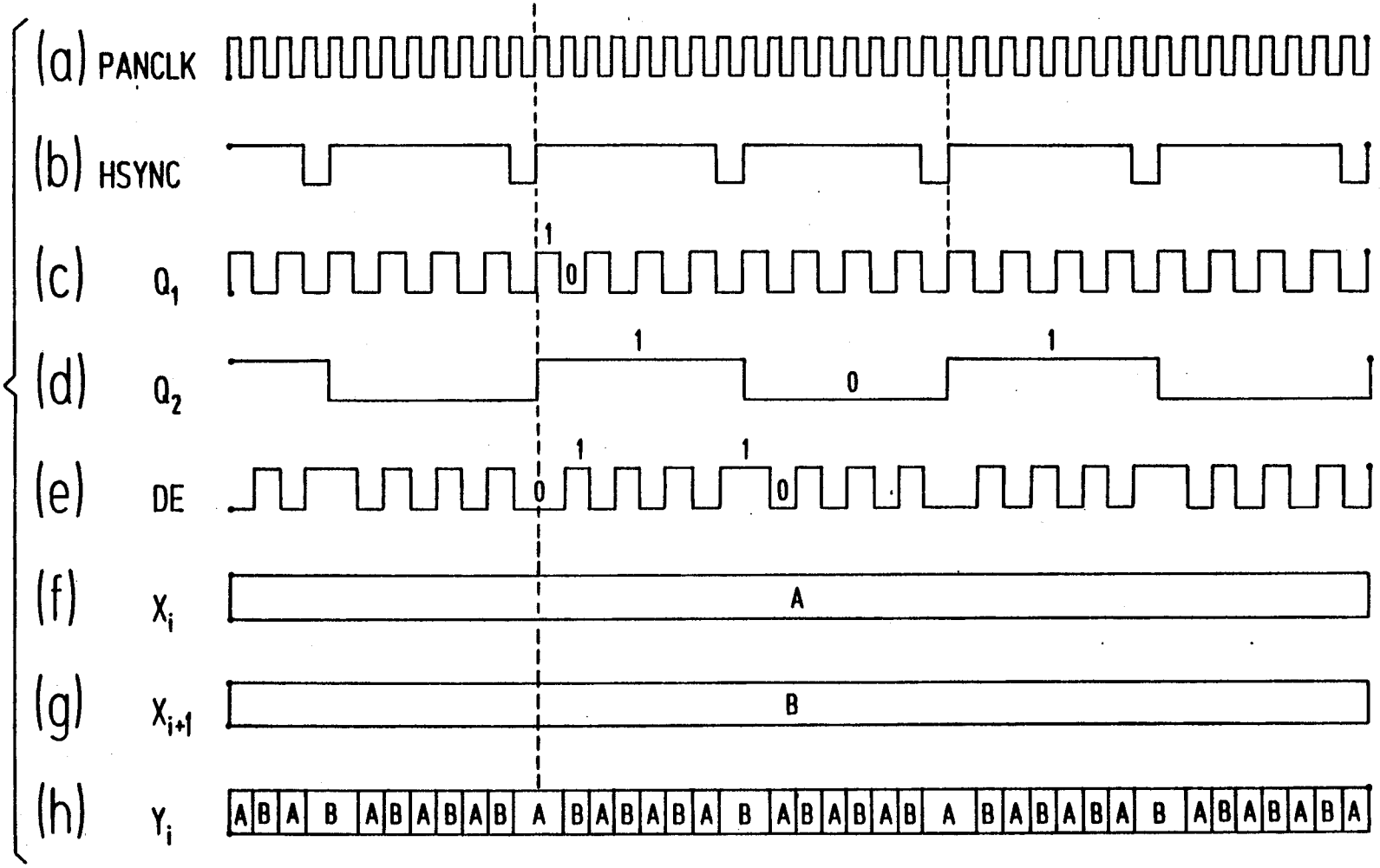
FIGS. 6(*a*), 6(*b*), 6(*c*), 6(*d*), 6(*e*), 6(*f*), 6(*g*), and 6(*h*) are a timing charts illustrating the operation of the half tone level generating portion of FIG. 5.
Figure 7A:
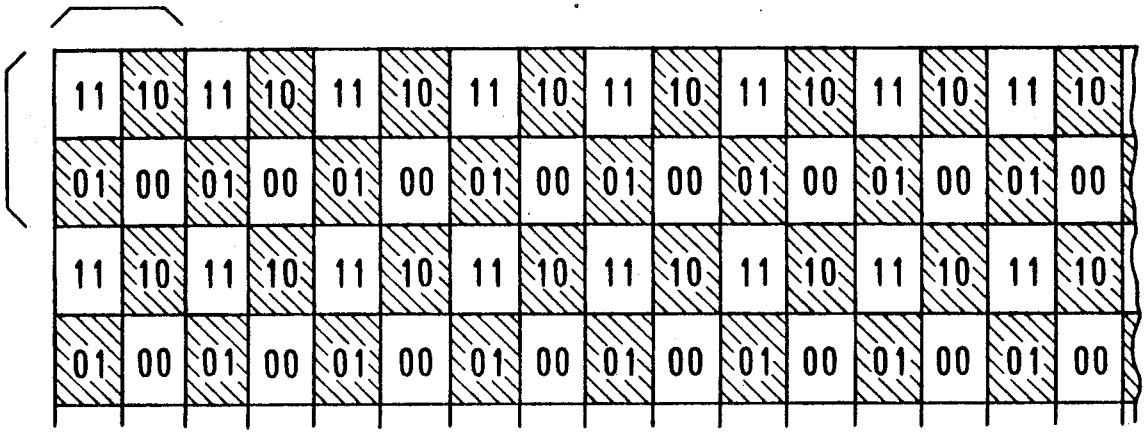
FIGS. 7(*a*) and (*b*) illustrate functions of the multi-tone level displaying unit of FIG. 4.
Figure 7B:
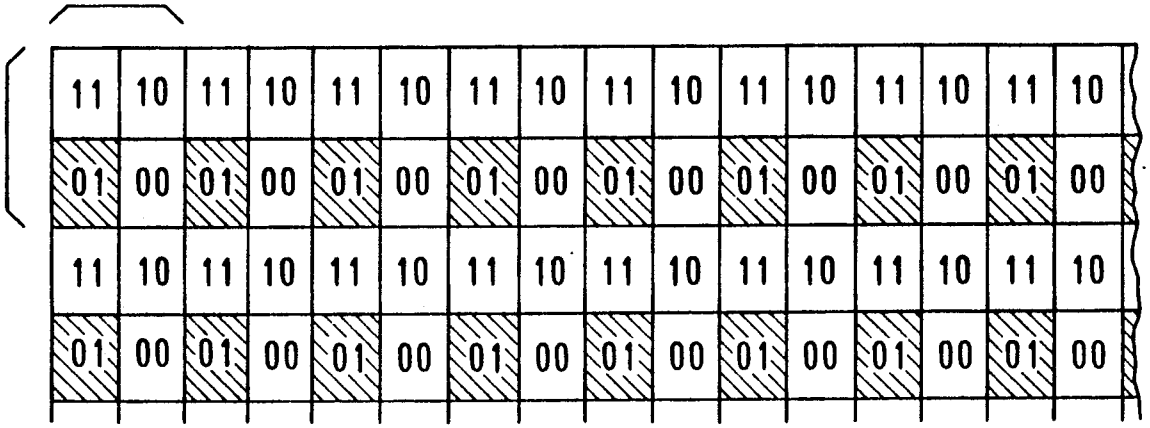

When an LCD panel as shown in FIG. 7(*a*) is 20 employed, 8 picture elements, i.e. 16 cells, or dots, are arranged in row, the panel clock signal PANCLK shown in FIG. 6(*a*), and the horizontal synchronizing signal HSYNC shown in FIG. 6(*b*) are supplied to the dither enable signal generating circuit 52. By the T-flip-flop circuit 52*a* and the T-flip-flop circuit 52*b*, the panel clock signal PANCLK is divided by ½, and the picture elements, each having 2×2 dots, are classified thereby.

Namely, as shown in FIG. 6(*c*), the output signal Q1 of T-flip-flop circuit 52*a* is changed to high level (logical value=1) when every other, or each odd-numbered pulse of panel clock signal PANCLK is supplied thereto, and the signal Ql is changed to low level (logical value=0) when each even-numbered pulse of signal PANCLK is supplied thereto. As shown in FIG. 6(*d*), the output signal Q2 of T-flip-flop circuit 52*b* is changed to high level (logical value=1) when each odd-numbered pulse of horizontal synchronizing signal HSYNC is supplied thereto, and the signal Q2 is changed to low level (logical value=0) when each even-numbered pulse of signal HSYNC is supplied thereto.

The exclusive-OR circuit 52c generates dither enable signal DE having, as shown in FIG. 6(*e*, a logical value of 1 when the signal Ql is opposite to the signal Q2. The LCD panel is classified to 2×2 dots area as shown in FIG. 7(*a*) according to the values of 2 bits for each cell. The dither enable signal DE which is shown in FIG. 6(*e*) is generated by the exclusive-OR circuit 52*c* to which the output signals Q1 and Q2 are supplied from the flip-flop circuits 52*a* and 52*b*. When Q1=1 and Q2=0, or Q1=0, and Q2=1, DE becomes 1, and when Q1=0 and Q2=0 or Q1=1 and Q2=1, DE becomes 0.

This enable signal DE is supplied to the selecting control terminal S of each of the selectors $SE_0$ to $SE_{15}$. The basic trains $X_i$ and $X_{i+1}$ are supplied to respective input terminals A and B of each selector $SE_0$ to $SE_{15}$, and these basic trains are a pair of adjoining trains among the basic trains $X_0$ to $X_{16}$ generated by the basic level generating portion 40 using FMR. The selectors $SE_0$ to $SE_{15}$ select the signal applied to terminal A when the signal DE applied to the terminal S is at its low level, and the signal applied to terminal B is selected when the signal DE applied to the terminal S is at its high level. If the train of signals applied to the terminal A is designated 'A', and the train of signals applied to the terminal B is designated 'B', as indicated by FIGS. 6(*f*) and (*g*), a train of output signals, Yi from the selector SEi is generated as shown in. FIG. 6 (*h*). This train Yi is a train generated by the dither method for displaying a half tone level. Hence, the half tone level generating circuit 53 generates trains of output signals and 16 half tone levels are displayed thereby.

Figure 8:
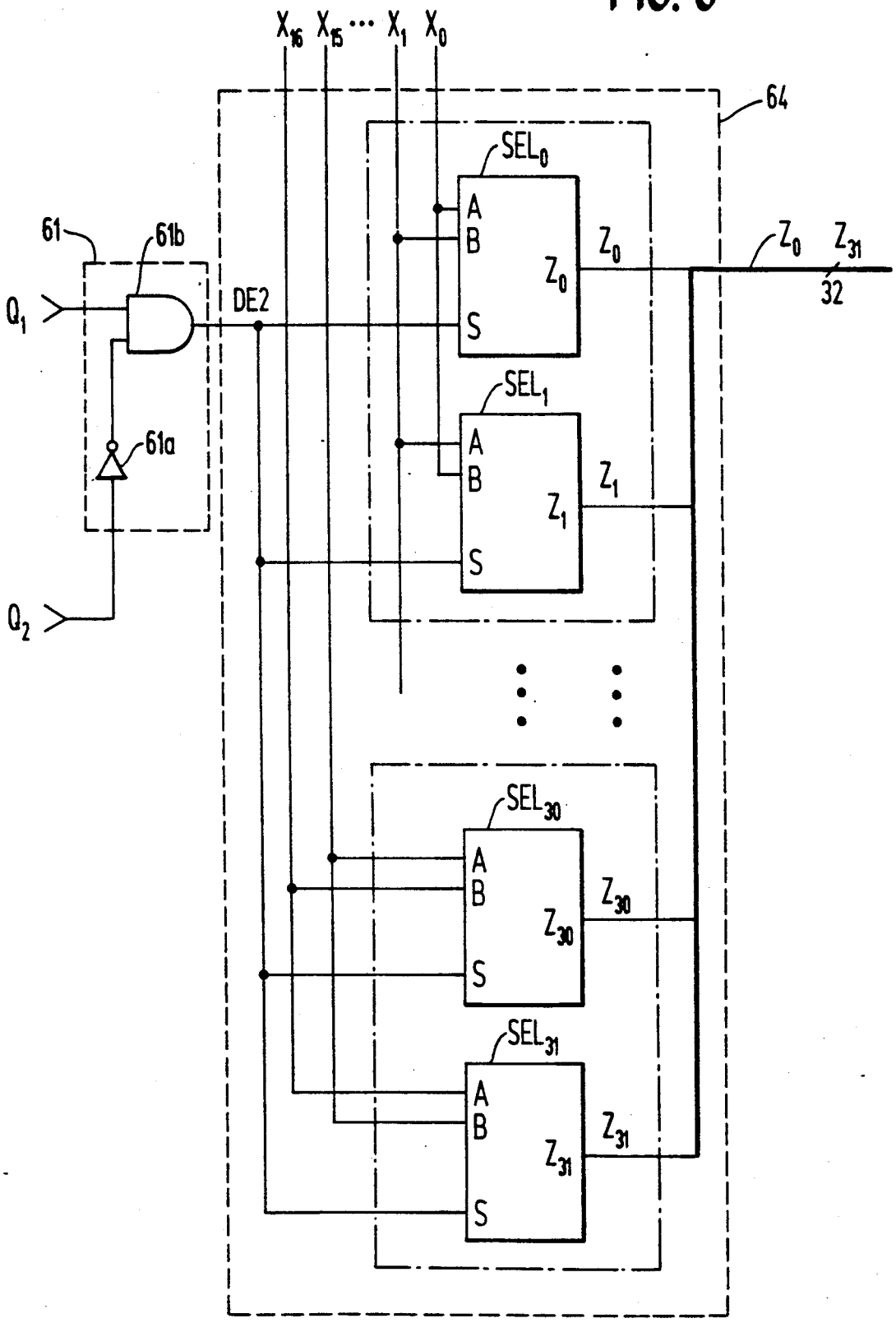
FIG. 8 is a block diagram showing an intermediate tone level generating portion of the multi-tone level displaying unit of FIG. 4.

Referring now to FIG. 8, the intermediate tone level generating portion 60 has a threshold value assigning circuit 61 and an intermediate tone level signal output circuit 64.

The threshold value assigning circuit 61 produces a second dither enable signal DE2 which assigns a selecting parameter (threshold value) to each dot in a 2×2 dot picture element based on the output signal Q1 from the T-flip-flop circuit 52*a* and the output signal Q2 from the T-flip-flop circuit, 52*b*. The T-flip-flop circuit 52*a* and the T-flip-flop circuit 52*b* thus constitute a picture element defining circuit 55.

The intermediate tone level generating circuit 64 is compoosed of selectors $SEL_0$ to $SEL_{31}$ for selecting displaying signal trains based on the basic trains $X_i$ and $X_{1+1}$ using the dither enable signal DE2, and these basic trains are a pair of adjoining trains among the basic trains $X_0$ and $X_{16}$ generated by the basic tone levels generating portion 40.

The threshold value assigning circuit 61 has an inverter for inverting the signal Q2, and an AND circuit 61*b* to which the inverted signal and the output signal Q1 are supplied. The signals of basic trains $X_i$ and $X_{i+1}$,, which are a pair of adjoining basic trains, are supplied to a pair of selectors $SEL_1$ and $SEL_{i+1}$, the signals of the basic train $X_i$ being supplied to a terminal A of selector $SEl_i$ and that of the train in $X_{i+1}$ being supplied to a terminal B of selector, $SEL_i$ . On the other hand, the signals of the train $X_i$ are supplied to a terminal B of selector $Sel_{i+1}$ that of the train $X_{i+1}$ is supplied to a terminal A of selector $SEL_{i+1}$.

The dither enable signal DE2 shown in FIG. 9(*e*) is generated by the threshold assigning circuit 61. Based on this dither enable signal DE2, cells on the LCD panel marked in FIG. 7(*b*) with hatching are selected. For example, since the basic train $X_i$ is supplied to an input terminal A of a selector $SEl_{2i}$ and the basic train $X_{1+1}$ is supplied to a input terminal.. B of this selector, a signal train $Z_{2i}$ shown in FIG. 9(*h*) is generated. The tone level displayed by this train $Z_{2i}$ is ¼ level between the tone level displayed by the train $X_i$, and the tone level displayed by the train $X_{1+1}$. On the other hand, the signals of the basic train $X_{i+1}$ are supplied to a terminal A of a selector $SE1_{2i+1}$ which is a partner of the selector $SEL_{2i}$ and that of the train $X_i$ is supplied to a terminal B of the selector $SEL_{2i+1}$, so that a signal train $Z_{2i+1}$ shown in FIG. 9(*i*) is generated. The tone level displayed by this train $Z_{2i+1}$ is ¾ level between the tone level by the train $X_i$ nd that by the train $X_{1+1}$. Hence, the intermediate tone level generating portion 60 generates signal trains $Z_0$ to $Z_{32}$ for displaying 32 tone levels.

As explained above, with this multi-tone level displaying unit, 16 half tone levels can be displayed based on the 17 basic tone levels produced by the FRM method and the dither matrix having two different threshold values but the same numbers of dots are assigned to the different threshold values. In addition, in this displaying unit, another 32 intermediate tone levels can be displayed based on the 17 basic tone levels and the dither matrix having the two different threshold values and a different number of dots is assigned, to each threshold value are different. Therefore, total number of tone levels which can be displayed with this displaying unit is 65 (17+16+32=65).

The number of tone levels which can thus be displayed becomes double of that with the conventional dither method, since the dither matrix (dither pattern) having the unequal numbers of dots assigned the different threshold values, and the inverse dither matrix thereof, are adopted. So, if a natural tone level which cannot be displayed by half tone levels, is required, it is possible to get a more natural tone image by the intermediate tone levels which can be generated by the method mentioned above. Hence, by the multi-tone level displaying unit according to this embodiment, high quality tone levels can be displayed using 64 tone levels.

Next, another embodiment of the present invention will be described with reference to FIGS. 10 to 13. In the embodiment described above, the displaying method uses a dither pattern which has the same number of dots with each threshold value (so called ½ and another dither pattern which has an unequal number of dots with each threshold value (so called ¼ dither pattern).

Figure 10C:
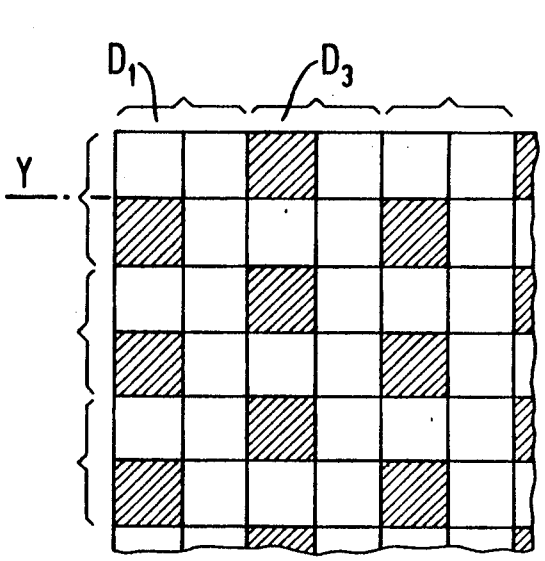
FIG. 10 (*a*) illustrates combinations of dither patterns using in the multi-tone level displaying unit of FIG. 4.
Figure 10B:
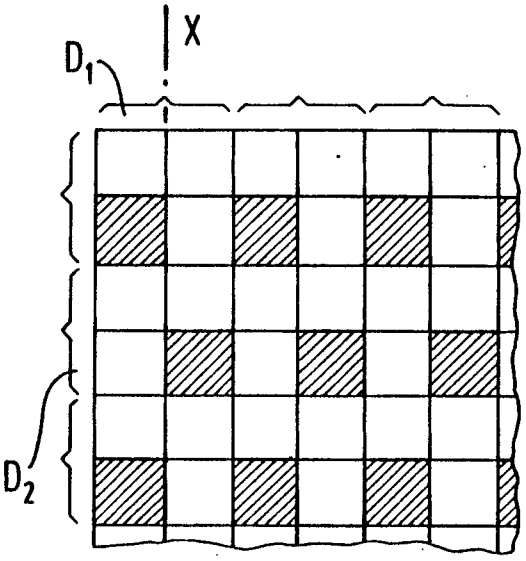
Figure 10A:
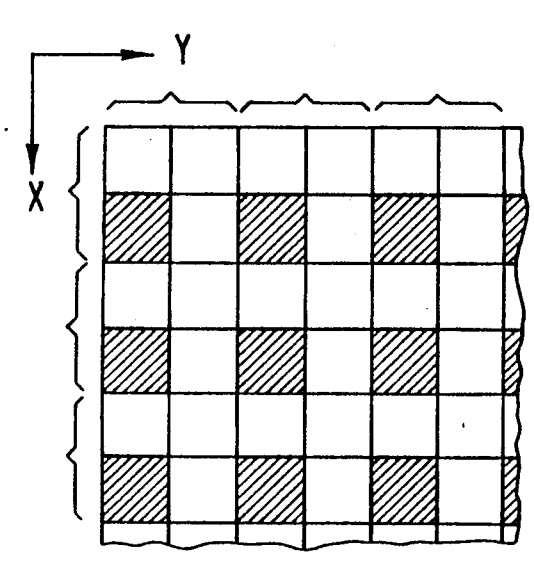

In the LCD, it may happen that an image produced by the above method consists of patterns shown in FIG. 10. In these patterns, one group of rows along the axis Y (Y rows) is arranged so that a kind of threshold value is effective alternatively, and another group of Y rows is acted on by only one kind of threshold value, so that some X rows thereof are associated with only one kind of threshold value. If an attempt is made to display an image having both light and dark levels on the above LCD panel, cross-talk would occur due to a characteristics of LCDs. Namely, the brightness level of rows in which a kind of threshold value is arranged alternatively is nearly the same as that of dark rows.

In rows in which only one kind of threshold value is effective, a background level of the LCD is displayed. Therefore, the image displayed by the above rows will have striped patterns. For example, when a certain middle tone level is displayed on the entire area of an LCD panel, it may happen that some striped patterns are displayed due to the cross-talk of data signals. In addition, if an image is displayed by patterns having rows in which a kind of threshold value is effective alternatively, the displayed image may show some black islands arranged in a line.

In order to get better quality images, with this embodiment, a ¼ dither pattern having a different arrangement of threshold values is applied alternatively to get intermittent tone levels. The dither patterns of the above is constituted by a different arrangement of threshold values, but the basic arrangement of the threshold values is the same as the ¼ dither pattern. Namely, as shown in FIG. 10(*b*), the dither pattern D1 for odd lines is different from the dither pattern D2 for even lines, and the pattern D1 is symmetrically arranged relative to the pattern D2 about the axis X. However, stripe patterns may be displayed along the Y axis. In case he ¼ dither patterns are used for displaying multi-tone levels, it is impossible to eliminate stripe patterns along both the X axis and the Y axis. However, as shown in FIG. 10(*c*), stripe patterns in an image along the Y axis can be eliminated if the dither pattern D1 is applied for odd-numbered vertical lines and dither pattern D3 is applied for even-numbered vertical lines. The pattern D1 is symmetrically arranged relative to the pattern D3 about the axis Y.

Figure 11:
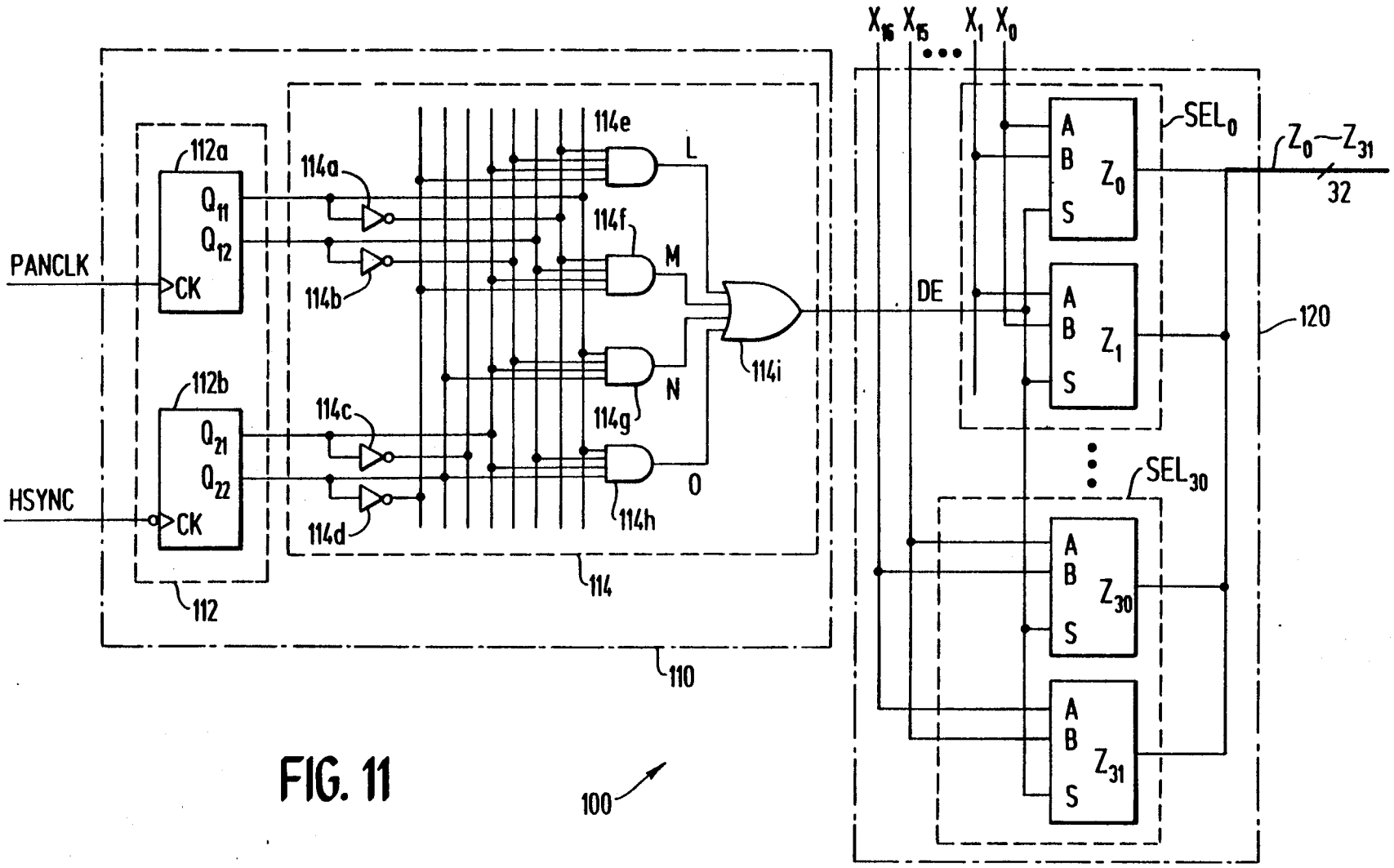
FIG. 11 is a block diagram showing the intermediate tone level generating portion of the multitone level displaying unit according to the other embodiment of the invention.

FIG. 11 shows a dither tone level generating portion in which a pair of dither patterns are used. These dither patterns are arranged symmetrically to each other. If a dither pattern of 2×2 dots is adopted, such dither pattern should be rearranged to control each picture element, so the control of related circuits become complex. For generating the intermediate tone level shown in FIGS. 10, a dither pattern of 4×4 dots is used since it is possible to recognize that the pattern shown in FIG. 10(*b*) is constructed by a unique dither pattern of 4×4 dots.

An intermediate tone level generating portion 100 shown in FIG. 11 has a dither enable signal generating circuit 110 and a multi-tone level signal output circuit 120. The multi-tone level signal output circuit 120 is the same as multi-tone level signal output circuit 53.

Figure 12:
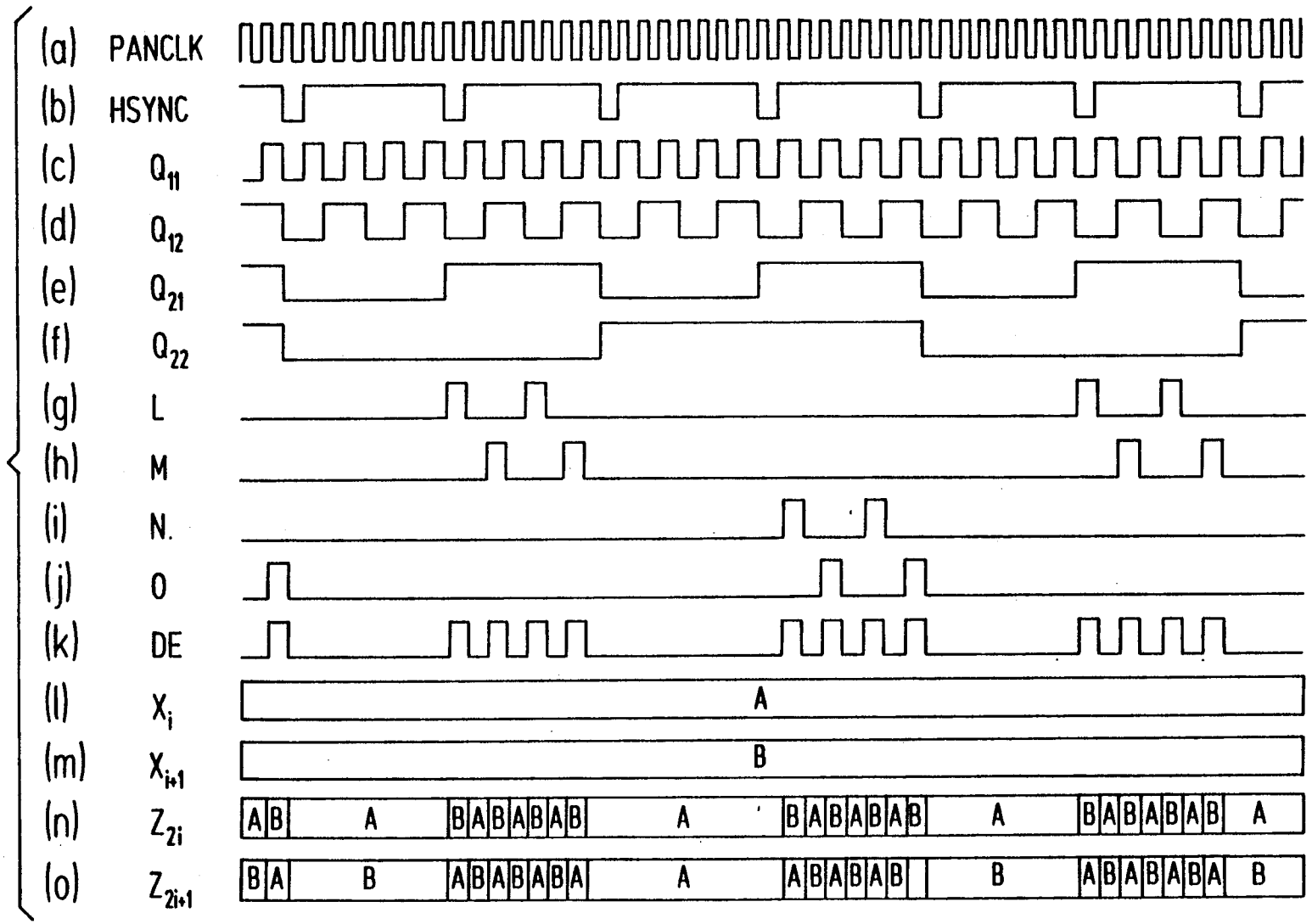
FIGS. 12(*a*), 12(*b*), 12(*c*), 12(*d*), 12(*e*), 12(*f*), 12(*g*), 12(*h*), 12(*i*), 12(*j*), 12(*k*), 12(*l*), 12(*n*), and 12(*o*) timing charts showing signals of the intermediate tone level generating portion of FIG. 11.
Figure 13:
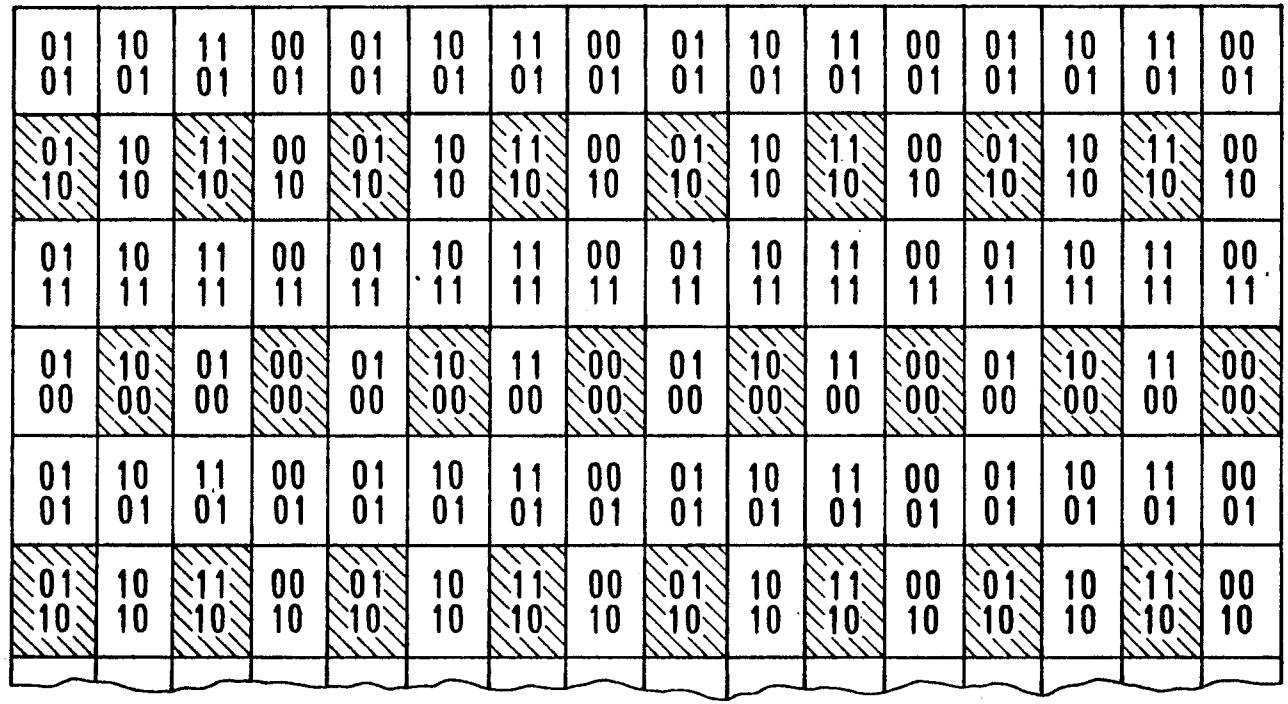
FIG. 13 illustrates functions of the intermediate tone level generating portion of FIG. 11.
Figure 16:
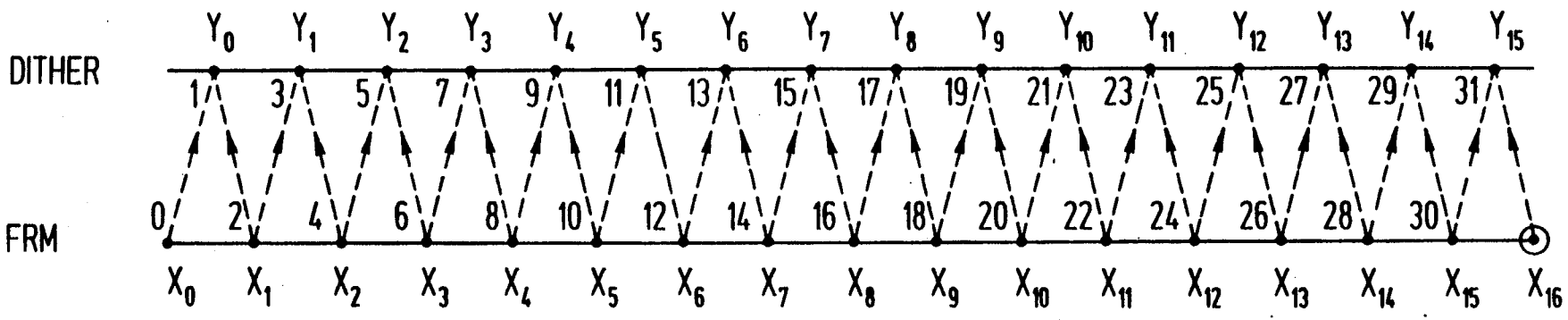

The dither enable signal generating circuit 110 is constituted by a picture element defining circuit 112 for defining an area having 4×4 dots, and a threshold value assigning circuit 114 for assigning a threshold value to each dot of the picture element defined by circuit 110. The picture element defining circuit 112 comprises a 2-bit counter 112*a* for counting up the pulses of panel clock signal PANCLK, and a 2-bit counter 112*b* for counting up the the pulses of horizontal synchronous signal HSYNC. Output signals Q11 and Q12 from the 2-bit counter 112*a* are shown in, FIGS. 12(*c*) and (*d*), and output signals Q21 and Q22 from the 2-bit counter 112*b* are shown in FIG. 12(*e*) and (*f*). On the basis of the signals Q11, Q12, Q21 and Q22, in the LCD, picture elements are defined by 4×4 liquid crystal cells (dots).

As shown in FIG. 11, the threshold value assigning circuit 114 comprises inverters 114*a* to 114*d*, AND circuit 114*e* to 114*h*, and an OR circuit 114i. The threshold value assigning circuit 114 assigns threshold values to cells shown with hatching and to cells shown without hatching, respectively, in FIG. 13. Namely, to the cells shown with hatching, low level signals (logical value is 0) are assigned, and to the cells shown without hatching, high level signals (logical value is 1) are assigned. The waveforms of output signals L, M, 0 and P from the AND circuits 114*e* to 114*h* are shown in FIGS. 12(*g*), (*h*), (*i*) and (*j*), and the waveform of the dither enable signal DE is shown in FIG. 12(*k*). Using this dither enable signal DE, by the same method as explained before, signal trains $Z_{2i}$ and $Z_{2i+1}$, which are shown in FIG. 12(*n*) and (*o*), are generated based on the basic trains $X_i$ and $X_{i+1}$.

Hence, 32 high quality dither tone levels can be displayed.

As explained above, on the bi-level display device, the intermediate tone levels are displayed by the newly generated signal trains based on a dither pattern in which the quantities of dots assigned the different threshold values are unequal, and on a dither pattern which is a reverse pattern of the above.

Therefore, in addition to the half tone levels, intermediate tone levels, i.e. unequally divided tone levels, can be displayed so that a more natural image than that displayed by half tone levels can be obtained. Since the reversed dither pattern is adopted, 64 tone levels, which is impossible to display by the conventional method, can be displayed with the same resolution and the same fineness, or detail. In addition, a high quality image can be displayed without stripe lines by the first and second binary dither patterns in which the different threshold values are assigned so that the each vertical and horizontal dot lines of dither pattern have at least one different threshold value each.

In the case of the embodiments described above, 64 tone levels are produced in a 2×2 display group by employing display cycles each composed of 16 time intervals. However, the number of time intervals can be varied. In addition, the desired display can be produced through the use of different sets of time intervals. For example, 8 tone levels can be produced during a period of 8 time intervals and 10 tone levels can be produced during a period of 10 time intervals and 16 desired tone levels can then be selected from all available levels.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

I claim:

1. A method for producing an image having a large number of light tone levels on a bi-level display device which has an image display area composed of a plurality of picture elements, each picture of individually element being constituted by a group of individually controllable dots, using a dither method, comprising:

providing a pair of signal trains for displaying a first basic tone level and an adjoining second basic tone level, respectively;

producing a first binary dither pattern associated with a number of adjacent dots in the display area corresponding to a picture element, the dither pattern having a pattern of two different threshold values arranged so that for each picture element one threshold value is associated with a number of dots different from the number of dots associated with the other threshold value;

producing a second binary dither pattern having the same two different threshold values in a pattern which is the reverse of that of said first dither pattern; and controlling the display device on the basis of the pair of signal trains and the first and second dither patterns to produce an image having two different tone levels situated between first and second basic tone levels.

2. A displaying method according to claim 1 wherein each picture element is constituted by a 2×2 dot group.

3. A displaying method according to claim 2 wherein each binary dither pattern is associated with a 2×2 dot group.

4. A displaying method according to claim 2 further comprising producing a second pair of binary dither patterns which are different from said first and second patterns and are based on one of the first and second patterns and are based on one of the first and second dither patterns, and further controlling the display device by causing a pair of adjoining picture elements to be displayed using the dither patterns of the second pair alternatively.

5. A displaying method according to claim 4 wherein said first and second dither pattern are associated with vertical dot lines or horizontal dot lines and each threshold value is associated with at least one dot in each vertical or horizontal dot line in each picture element.

6. A display control unit for producing an image having a large number of light tone levels on a bi-level display device which has an image display ara composed of a plurality of picture elements, each picture element being constituted by a group of individually controllable dots, in which, based on a pair of signal trains $X_i$ and $X_{1+1}$ selected from among a larger number of signal trains for displaying basic tone levels, a first tone level and an adjoining second tone level are displayed on the display area and additional signal trains $Z_{2i}$ and $Z_{2i+1}$ are generated for effecting display on the display area of intermediate tone levels which are situated between the first and second tone levels and are each spaced unequally from the first and second tone levels, comprising:

a dither enable signal generating means for generating a dither enable signal by which a first threshold value an a second threshold value are assigned to dots in a picture element in a manner such that one threshold value is associated with a number of dots different from the number of dots associated with the other threshold value and, a dither tone level output means for generating the additional signal trains $Z_{2i}$ and $Z_{2i+1}$ by combining signal trains $X_i$ and $X_{1+1}$ serially and/or alternatively under control of the dither enable signal.

7. A display control unit according to claim 6 wherein said dither enable signal generating means comprises a picture element defining means for defining a picture element constituted by the group of dots based on panel clock signals and on horizontal synchronizing signals of display cells, and a threshold value assigning means for generating the dither enable signal such that for each picture element one threshold value is associated with at least one dot and the other threshold value is associated with a plurality of dots and the number of dots associated with the one threshold value is different from the number of dots associated with the other threshold value.

8. A display control unit according to claim 6, wherein sid dither enable signal generating means comprises a picture element defining means for generating signals for defining a picture element to have 4×4 dots based on a panel clock signal and a horizontal synchronizing signal of display cells, and a threshold value assigning means for generating the dither enable signal which is so arranged, based on the first and second threshold values, that each threshold value is associated with at least one dot in each vertical or horizontal dot line in each picture element.

9. A display control unit according to claim 7 wherein said dither tone level output means comprises signal selecting means by which one of the signal trains $X_i$ and $X_{1+1}$ is selected alternatively under the control of the dither enable signal.

10. A display control unit according to claim 9 wherein said signal selecting means comprises a plurality of pairs of signal selecting devices each having first and second input terminals, an each of signal trains $X_i$ and $X_{i+1}$ is supplied to a respectively different input termianl of each selecting means of a respective pair.

* * * * *